US009820623B2

(12) United States Patent
Ha

(10) Patent No.: US 9,820,623 B2
(45) Date of Patent: Nov. 21, 2017

(54) VACUUM CLEANER AND CONTROL METHOD OF THE SAME

(71) Applicant: LG ELECTRONICS INC., Seoul (KR)

(72) Inventor: Gunho Ha, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 15/264,174

(22) Filed: Sep. 13, 2016

(65) Prior Publication Data

US 2017/0071430 A1 Mar. 16, 2017

(30) Foreign Application Priority Data

Sep. 14, 2015 (KR) ..... 10-2015-0129472

(51) Int. Cl.
*A47L 9/28* (2006.01)
*A47L 5/36* (2006.01)

(52) U.S. Cl.
CPC ..... *A47L 9/2805* (2013.01); *A47L 5/36* (2013.01); *A47L 9/2852* (2013.01)

(58) Field of Classification Search
CPC ..... A47L 5/36; A47L 9/2805; A47L 9/2852; A47L 5/00; A47L 7/00; A47L 9/28
USPC ..... 15/319, 327.2, DIG. 10
See application file for complete search history.

(56) References Cited

U.S. PATENT DOCUMENTS 8,613,125 B2 * 12/2013 Jeong ..... A47L 5/362 15/319
2004/0015266 A1 * 1/2004 Skoog ..... B25J 5/007 700/245

FOREIGN PATENT DOCUMENTS

| | | |
|---|---|---|
| CN | 101516245 | 8/2009 |
| CN | 101677736 | 3/2010 |
| KR | 10-1999-0048459 | 7/1999 |
| KR | 10-2007-0027840 | 3/2007 |
| KR | 10-0756717 | 9/2007 |
| KR | 10-2008-0088020 | 10/2008 |
| KR | 10-0876693 | 12/2008 |
| KR | 10-1012953 | 2/2011 |

OTHER PUBLICATIONS

International Search Report dated Jan. 16, 2017 issued in Application No. PCT/KR2016/010301.

* cited by examiner

*Primary Examiner* — David Redding
(74) *Attorney, Agent, or Firm* — KED & Associates, LLP

(57) ABSTRACT

A vacuum cleaner includes a cleaner main body; a suction device communicated with the cleaner main body; a wheel which may move the cleaner body; a motor for driving the wheel; a sensor for detecting a rotation angle of the cleaner main body about a rotation angle of the wheel; a memory in which a plurality of reference values about the sensor are stored; and a controller determining one reference value of the plurality of reference values and controlling the motor according to a size of an angle value detected from the sensor based on the determined reference value.

9 Claims, 7 Drawing Sheets

VACUUM CLEANER AND CONTROL METHOD OF THE SAME

CROSS-REFERENCE TO RELATED APPLICATION(S)

This present application claims priority under 35 U.S.C. 119 and 35 U.S.C. 365 to Korean Patent Application No. 10-2015-0129472 (filed on Sep. 14, 2015), which is hereby incorporated by reference in its entirety.

BACKGROUND

1. Field

A vacuum cleaner and a control method of the same are disclosed herein.

2. Background

Generally, a vacuum cleaner is an apparatus which suctions air including dust by using a vacuum pressure generated by a suction motor installed inside a main body, and filters the dust in the main body.

The vacuum cleaner may be classified into a canister type in which a suction portion for sucking the air including the dust is provided separately with the main body and connected by a connecting pipe, and an up-right type in which a suction device is directly connected to the main body.

And, in the case of the canister type vacuum cleaner, cleaning may be performed as the suction portion is moved forward and backward or left and right while the main body is stopped, and in the case of the up-right type vacuum cleaner, cleaning may be performed as the main body and the suction portion are moved at the same time.

Of course, in the case of the canister type, when the suction portion is spaced apart from the main body, the main body may be moved by a force through which a user pulls the main body.

In Korean Patent Publication No. 10-1012953 (published on Jan. 27, 2011), there is disclosed a vacuum cleaner which may move a main body automatically.

The vacuum cleaner of the prior art may include a main body; a main wheel for moving the main body; a driving motor for driving the main wheel; a detecting portion for detecting a rotation of the main body; and a controller controlling an operation of the driving motor by comparing a detecting value detected from the detecting portion and a determined reference value.

And, in order to prevent an abnormal motion of the main body about an error of the detecting portion, a step determining the reference value is performed when power is supplied to the main body.

In the case of the prior art, as an average value of an angle value while the main body is rotated in one direction and an angle value while the main body is rotated in the other direction is determined as the reference value, the reference value is always constant, and thus the error of the detecting portion may be reduced.

However, a position of weight center of the main body is varied according to a height of the user, flooring material, distribution on cleaner production, and dust quantity in the cleaner, but in the case of the prior art, since the reference value is constant, there is an disadvantage that the main body may not perform an optimal driving.

For example, in the case of a tall person, cleaning is performed while the main body is tilted slightly backward, and in the case of a short person, cleaning is performed while the main body is titled slightly forward, but when the reference value is constant, there may be a problem that the main body is unintentionally moved forward or backward depending on the height of the user.

SUMMARY

The present invention is directed to providing a vacuum cleaner which may be moved automatically by following a user, and a control method of the same.

The present invention is also directed to providing a vacuum cleaner which may perform an optimum driving performance as determining a reference in response to changes in a weight center of a cleaner main body.

A vacuum cleaner comprises a cleaner main body; a suction device communicated with the cleaner main body; a wheel which may move the cleaner main body; a motor for driving the wheel; a sensor for detecting a rotation angle of the cleaner main body about a rotation angle of the wheel; a memory in which a plurality of reference values about the sensor are stored; and a controller determining one reference value of the plurality of reference values and controlling the motor according to a size of an angle value detected from the sensor based on the determined reference value.

The controller may determine any one of the plurality reference values after operating the motor about each of the plurality of reference values.

For determining one reference value of the plurality of reference values, the controller may rotate the motor at a reference angle in a second direction which is opposite to a first direction after rotating the motor at the reference angle in the first direction.

A current detecting portion for detecting a current of the motor may be further included, and the current may be detected from the current detecting portion whenever the motor is operated about each of the reference values, and the controller may determine a reference value having a minimum current value among the current values detected from the current detecting portion.

The sensor may be one of an angle sensor, an acceleration sensor and a gyro sensor.

The controller may determine any one reference value of the plurality of reference values whenever the cleaner main body starts to be operated.

In the case in which the angle value detected from the sensor departs from a range of forward and backward angle value, the controller may control the motor so that the cleaner main body moves forward or backward.

The forward angle value or the backward angle value may be varied depending on the reference value.

An auxiliary wheel for a movement of the cleaner main body may be further included, and when the angle value detected from the sensor is within the range of the forward and backward angle value, the auxiliary wheel may be spaced apart from the bottom.

A vacuum cleaner comprises a cleaner main body; a suction device communicated with the cleaner main body; a wheel which may move the cleaner main body; a motor for driving the wheel; a sensor detecting a value changed depending on a movement of a detection target about a rotation center of the wheel; and a controller controlling the motor depending on a detecting value detected from the sensor, and when the detecting value exceeds a forward reference value, the controller controls the motor so that the cleaner main body moves forward, and when the detecting value exceeds a backward reference value, the controller controls the motor so that the cleaner main body moves backward.

Also another aspect of the present invention provides a control method of the vacuum cleaner including a step in which a starting command of a cleaner main body is input; a step in which a sensor provided in the cleaner main body detects a value changed depending on a movement of a detection target; and a step controlling a motor for rotating a wheel of the cleaner main body according to a detecting value detected from the sensor.

When the detecting value exceeds the forward reference value, the controller may control the motor so that the cleaner main body moves forward, and when the detecting value exceeds the backward reference value, the controller may control the motor so that the cleaner main body moves backward.

The detection target may be the cleaner main body.

The detecting value may be a rotation angle of the cleaner main body about a rotation center of the wheel.

The sensor may be one of an angle sensor, an acceleration sensor and a gyro sensor.

When the detecting value is equal to or less than the forward reference value while the cleaner main body moves forward, the controller may stop the motor.

When the detecting value is equal to or less than the backward reference value while the cleaner main body moves backward, the controller may stop the motor.

In the case in which the detecting value detected from the sensor is within a range of the forward reference value and the backward reference value while the motor is stopped, the controller may maintain a state in which the motor is stopped.

According to the proposed invention, as the cleaner main body is moved automatically in the cleaning process by a detection of tilt of the cleaner main body, a distance between the user and the cleaner main body may be maintained in a certain distance.

Therefore, since the user does not need to move the cleaner main body directly, there is an advantage that a cleaning convenience of the user is improved.

Also, since one reference value of the plurality of reference values is decided whenever the cleaning is performed based on a position of a weight center line of the cleaner main body, and whether the movement of the cleaner main body is determined based on the determined reference value, an abnormal motion of the main body may be prevented.

BRIEF DESCRIPTION OF THE DRAWINGS

Embodiments will be described in detail with reference to the following drawings in which like reference numerals refer to like elements, and wherein.

DETAILED DESCRIPTION

Figure 1:
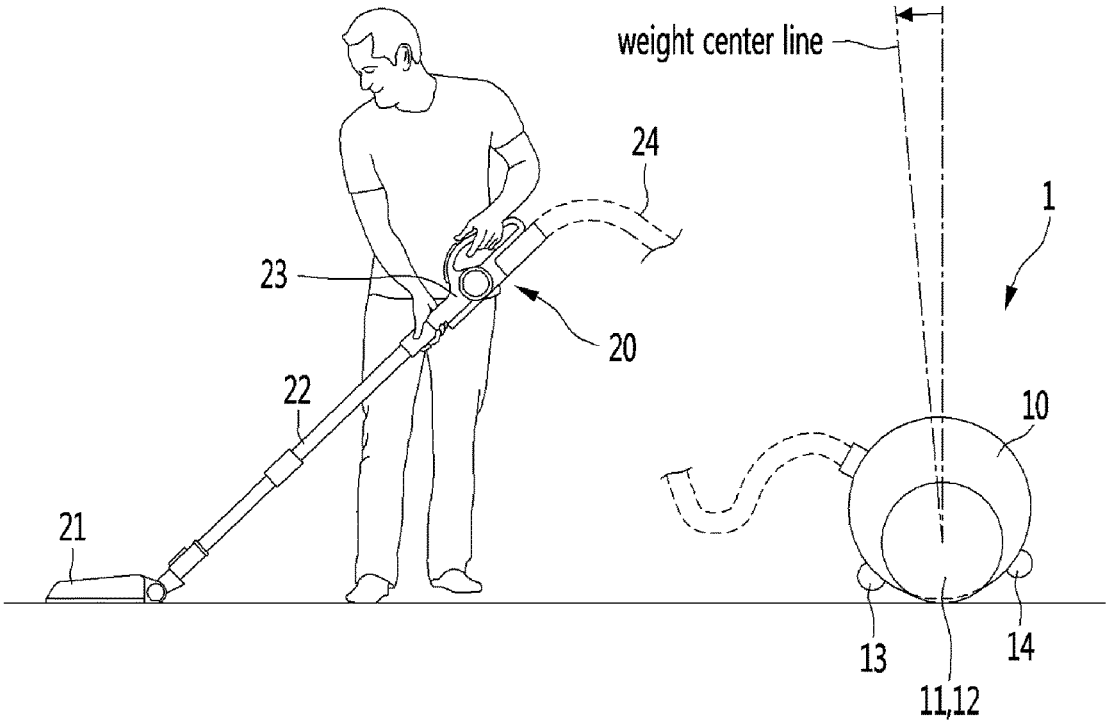
FIG. 1 is a view illustrating a vacuum cleaner when a first user performs a cleaning.

Reference will now be made in detail to the embodiments of the present disclosure, examples of which are illustrated in the accompanying drawings.

Hereinafter, exemplary embodiments of the present disclosure will be described with reference to the accompanying drawings. Regarding the reference numerals assigned to the elements in the drawings, it should be noted that the same elements may be designated by the same reference numerals, wherever possible, even though they are shown in different drawings. Also, in the description of embodiments, detailed description of well-known related structures or functions may be omitted when it is deemed that such description may cause ambiguous interpretation of the present disclosure.

Also, in the description of embodiments, terms such as first, second, A, B, (a), (b) or the like may be used herein when describing components of the present invention. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected," "coupled," and "joined" to the latter via another component.

Figure 2:
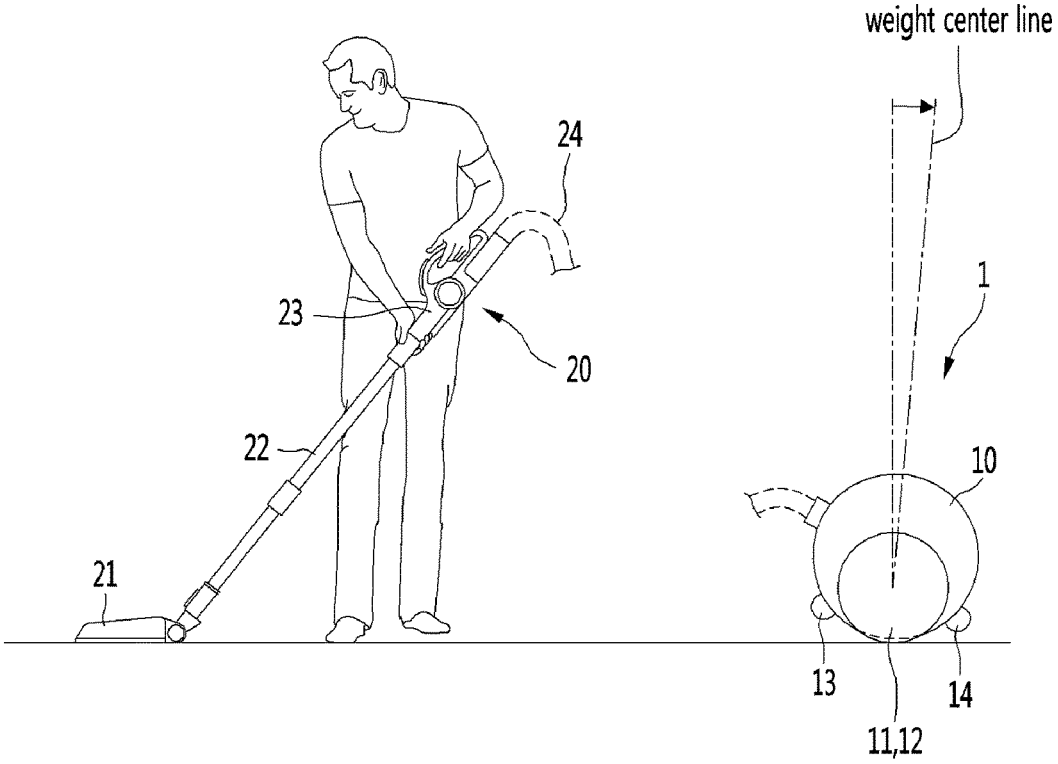
FIG. 2 is a view illustrating the vacuum cleaner when a second user performs the cleaning.
Figure 3:
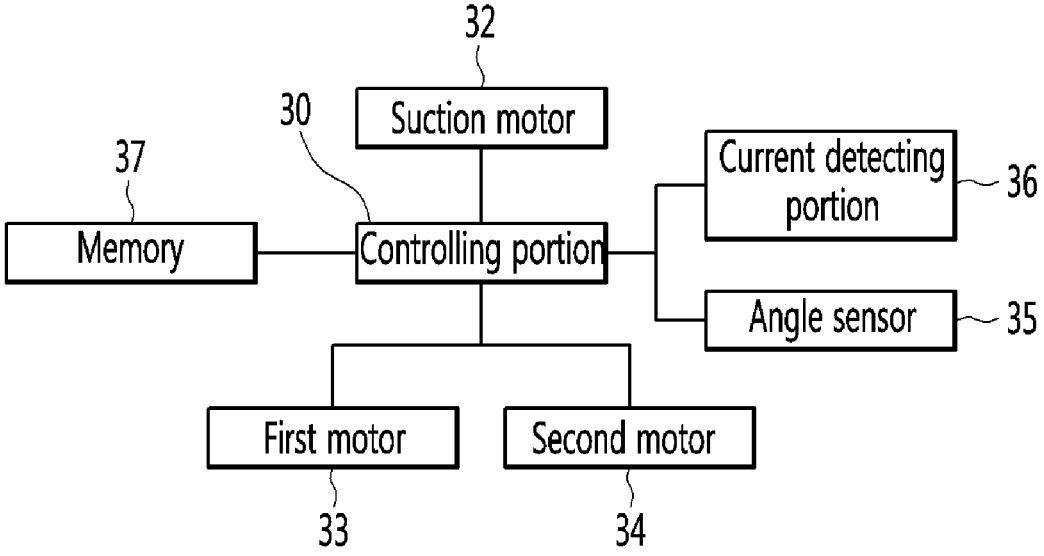
FIG. 3 is a block diagram of the vacuum cleaner according to an embodiment of the present invention.

FIG. 1 is a view illustrating a vacuum cleaner when a first user performs a cleaning, FIG. 2 is a view illustrating the vacuum cleaner when a second user performs the cleaning, and FIG. 3 is a block diagram of the vacuum cleaner according to an embodiment of the present invention.

Referring to FIGS. 1 to 3, a vacuum cleaner 1 according to an embodiment of the present invention may include a cleaner main body 10 having a suction motor 32.

Also, the vacuum cleaner 1 may include one or more main wheels 11 and 12 for a movement of the cleaner main body 10. The vacuum cleaner 1 may include a plurality of main wheels 11 and 12 so as to move stably.

The plurality of main wheels 11 and 12 may include a first wheel 11 and a second wheel 12.

The cleaner main body 10 may be rotated about a rotation center of the plurality of main wheels 11 and 12. That is, the rotation center of the plurality of main wheels 11 and 12 may be matched with a rotation center of the cleaner main body 10.

A weight center of the cleaner main body 10 may be positioned higher than the rotation center of the plurality of main wheels 11 and 12, but is not limited thereto. In this case, the cleaner main body 10 is in an unstable state and the rotation of the cleaner main body 10 with respect to the rotation center may be performed smoothly.

While the cleaner main body 10 is rotated, the vacuum cleaner 1 may further include a plurality of auxiliary wheels 13 and 14 helping the movement of the cleaner main body 10.

In the present invention, when the cleaner main body 10 is rotated in a counterclockwise direction based on the FIG. 1, that is defined to be rotated in a front direction (a first direction), and when rotated in a clockwise direction, that is defined to be rotated in a rear direction (a second direction).

The plurality of auxiliary wheels 13 and 14 may include a first auxiliary wheel 13 which may be in contact with a bottom surface when the cleaner main body 10 is rotated in the front direction and a second auxiliary wheel 14 which may be in contact with the bottom surface when the cleaner main body 10 is rotated in the rear direction.

According to the rotation angle of the cleaner main body 10, the cleaner main body 10 and the plurality of auxiliary wheels 13 and 14 may be spaced apart from the bottom surface.

The vacuum cleaner 1 may further include a plurality of motors 33 and 34 driving each of the plurality of main wheels 11 and 12.

The motors 33 and 34 may be controlled to maintain a state in which the cleaner main body 10 and the plurality of auxiliary wheels 13 and 14 are spaced apart from the bottom surface.

At this time, a state in which the plurality of auxiliary wheels 13 and 14 are not in contact with the bottom surface may be a self-supporting state of the cleaner main body 10.

The plurality of motors 33 and 34 may include a first motor 33 connected to the first wheel 11 and a second motor 34 connected to the second wheel 12.

Each of the motors 33 and 34 may operate independently. Therefore, the cleaner main body 10 may not only move forward and backward, but also turn left or right.

The vacuum cleaner 1 may further include a suction device 20 guiding air including dust to the cleaner main body 10.

The suction device 20 may include a suction portion 21 for sucking dust of a cleaning surface, in one example the bottom surface, and connecting portions 22, 23, and 24 for connecting the suction portion 21 to the cleaner main body 10.

The connecting portions 22, 23 and 24 may include an extension tube 22 connected to the suction portion 21, a handle 23 connected to the extension tube 22, and a suction hose 24 connecting the handle 23 to the cleaner main body 10.

The vacuum cleaner 1 may further include an angle sensor 35 for detecting the rotation angle of the cleaner main body 10, and a controller 30 controlling the plurality of motors 33 and 34 based on the angle detected from the angle sensor 35.

As shown in FIG. 1, in the case in which a first user uses the vacuum cleaner 1, the weight center line connecting the rotation center and the weight center may be inclined by a certain angle forward based on a vertical line. In this state, the cleaner main body 10 may maintain the self-supporting state without the operation of the motors 33 and 34.

As shown in FIG. 2, in the case in which a second user who is taller than the first user uses the vacuum cleaner 1, the weight center line may be inclined by a certain angle backward based on the vertical line. In this state, the cleaner main body 10 may maintain the self-supporting state without the operation of the motors 33 and 34.

And, in the state as shown in FIG. 1, in the case in which a clockwise rotation angle of the cleaner main body 10 is increased by a first angle, the motors 33 and 34 should be operated for the self-supporting of the cleaner main body 10, but in the state as shown in FIG. 2, even if the clockwise rotation angle of the cleaner main body 10 is increased by the first angle, it may maintain the self-supporting state without the operation of the motors 33 and 34.

Like this, in one example, according to the user's height, a relative position of the weight center line about the vertical line may be changed, and the optimum driving of the cleaner main body 10 is possible by operating the motors 33 and 34 to reflect the position of this weight center line.

In the present invention, according to the weight center line, a reference value of the angle sensor 35 may be varied.

A plurality of reference values of the angle sensor 35 are set, and according to the weight center line, any one reference value of the plurality of reference values may be determined.

For determining the reference value of the angle sensor 35, the vacuum cleaner 1 may further include a current detecting portion 36 detecting a current of each of the motors 33 and 34.

The vacuum cleaner 1 may further include a memory 37 in which the plurality of reference values are stored. In the memory 37, the reference value determined according to the weight center line may be stored additionally.

Hereinafter, a process of determining the reference value of the angle sensor 35 will be described.

Figure 4:
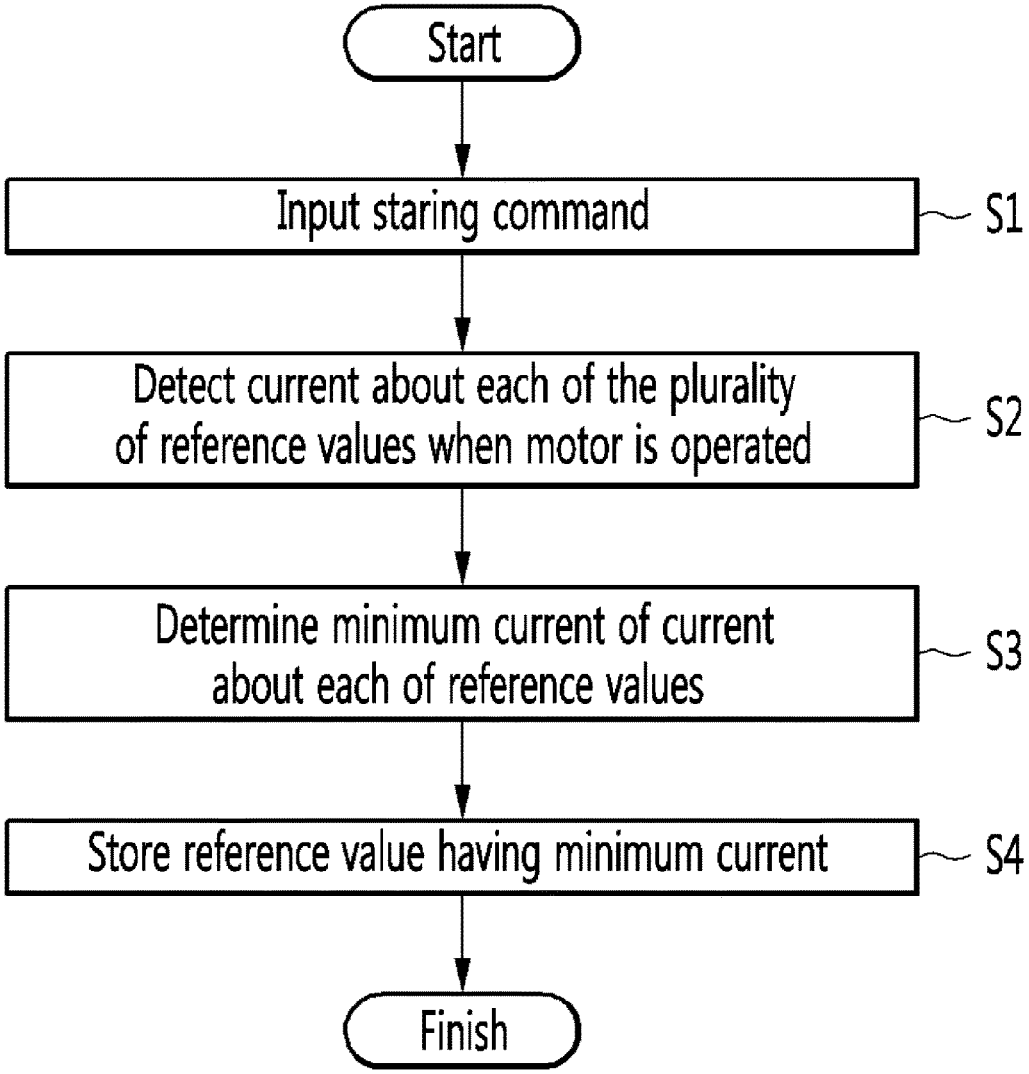
FIG. 4 is a flow diagram illustrating a method for determining a reference value of an angle sensor of the vacuum cleaner.
Figure 5:
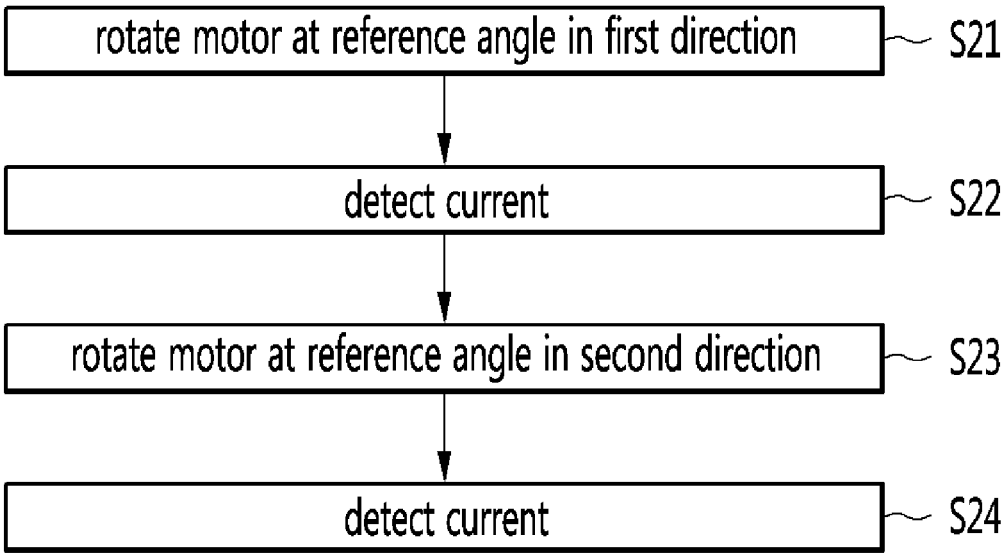
FIG. 5 is a flow diagram illustrating a control method of a motor for determining the reference value of the angle sensor.
Figure 6:
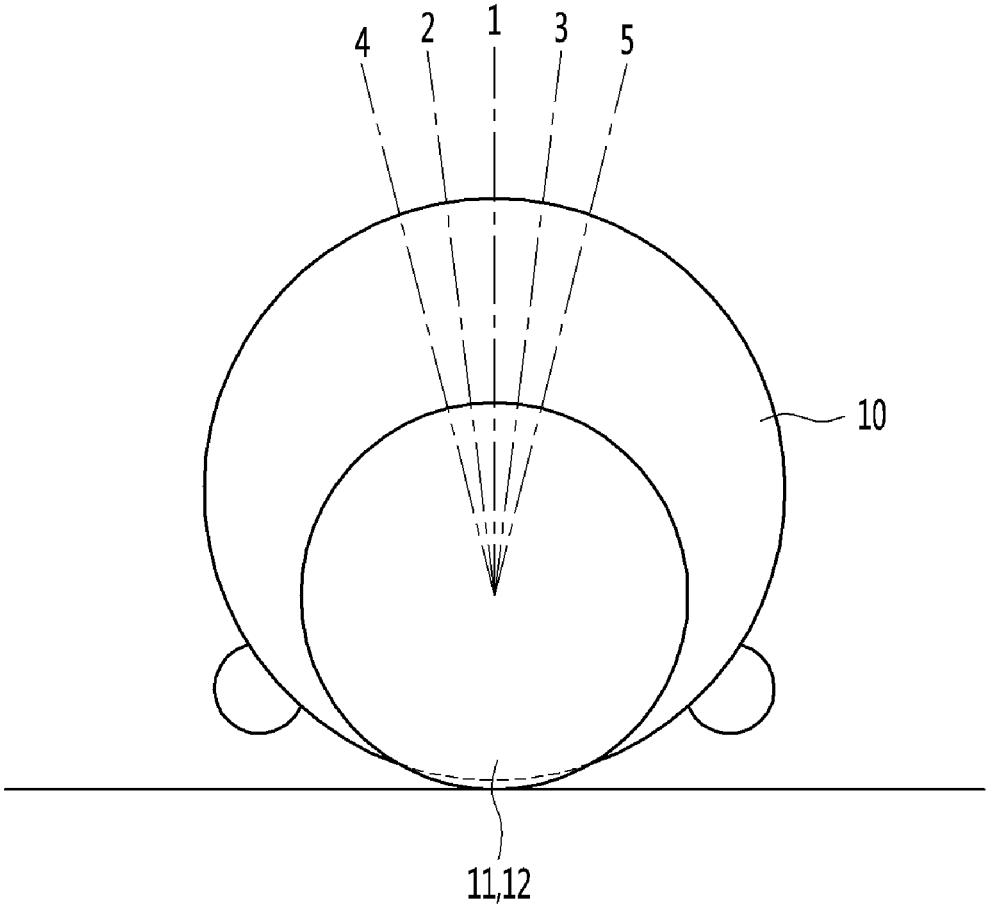
FIG. 6 is a view illustrating a plurality of reference values which may be determined.

FIG. 4 is a flow diagram illustrating a method for determining a reference value of an angle sensor of the vacuum cleaner, FIG. 5 is a flow diagram illustrating a control method of a motor for determining the reference value of the angle sensor, and FIG. 6 is a view illustrating a plurality of reference values which may be determined.

Referring to FIGS. 4 to 6, a starting command of the vacuum cleaner 1 is input (S1).

When the starting command of the vacuum cleaner 1 is input, the controller 30 drives the motors 33 and 34 about each of the plurality of reference values stored in the memory 37 and detects the current (S2).

Specifically, as shown in FIG. 6, in one example, five reference values are pre-set, and first, respect to a first reference value, the motors 33 and 34 are rotated at the reference angle in the first direction (S21). In a rotation process of the motors 33 and 34, the current is detected from the current detecting portion 36 (S22), and the detected current is stored in the memory 37.

And, the motors 33 and 34 are rotated at the reference angle in the second direction (S23). And, in the rotation process of the motors 33 and 34, the current is detected from the current detecting portion 36 (S24), and the detected current is stored in the memory 37.

After the completion of the current detection about the first reference value, the current detection of a second reference value is performed. In such a method, the current detection of the first reference value to a fifth reference value is performed.

And, a minimum current is determined by comparing the detected current value of each of the reference values (S3). And, a reference value having the minimum current is determined, and the determined reference value is stored (S4).

According to the position of the weight center line of the cleaner main body 10, when each of the motors 33 and 34 is driven in the first and second direction at the reference angle, the current detected from the current detecting portion 36 is different, and in the present embodiment, the minimum current detected from the current detecting portion 36 determines the reference value.

For example, as shown in FIG. 1 when the weight center line is positioned, the reference value having the minimum current detected from the current detecting portion 36 may be the second reference value in the FIG. 6.

On the other hand, as shown in FIG. 2 when the weight center line is positioned, the reference value having the minimum current detected from the current detecting portion 36 may be a fourth reference value in the FIG. 6.

Determination of such a reference value may be performed whenever an operation start command (or a cleaning start command) is input. That is, the reference value may be initialized whenever the cleaning operation is started.

Figure 7:
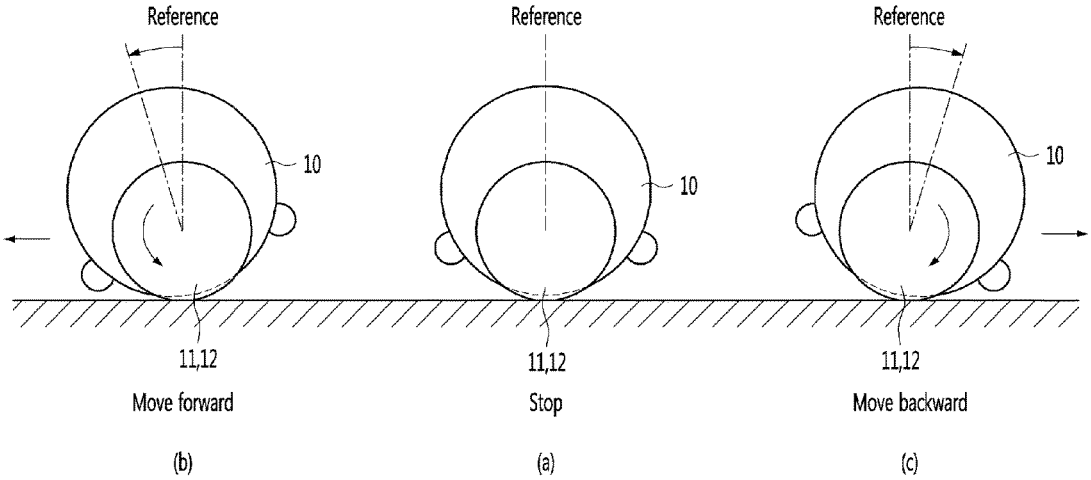
FIG. 7 is a view illustrating a using state of the vacuum cleaner of the present invention.

FIG. 7 is a view illustrating a using state of the vacuum cleaner of the present invention.

In the FIG. 7, (a) shows a state in which the cleaner main body 10 is self-supported, (b) shows a state in which the cleaner main body 10 is rotated more than the forward angle value in the front direction and then moves forward, and (c) shows a state in which the cleaner main body 10 is rotated more than the backward angle value in the rear direction and then moves backward.

Referring to FIGS. 1 to 7, the operation start command is input, and the reference value is determined. Then, the user moves the suction portion 21 forward and backward in the cleaning performing process, and correspondingly, the cleaner main body 10 is inclined to the front or rear side.

Then, in the angle sensor 35, the rotation angle of the cleaner main body 10 is detected, and the controller 30 compares the angle value detected from the angle sensor 35 and a reference angle value. At this time, the reference angle value may include the forward angle value and the backward angle value.

In one example, in the case in which the angle value detected from the angle sensor 35 is within the range of the forward angle value and the backward angle value, the controller 30 maintains a state in which the motors 33 and 34 are stopped.

On the other hand, in the case in which the angle value detected from the angle sensor 35 departs from the range of the forward angle value and the backward angle value, the controller 30 may control the motors 33 and 34 so that the cleaner main body 10 moves forward or backward.

For example, like (b) of FIG. 7, when the angle value detected from the angle sensor 35 exceeds the forward angle value, the controller 30 may control the motors 33 and 34 so that the cleaner main body 10 moves forward.

When the motors 33 and 34 are operated, an absolute value of the angle value detected from the angle sensor 35 becomes smaller, and thus the cleaner main body 10 is in a state like (a) of FIG. 7.

When the angle value detected from the angle sensor 35 is within the range of the forward angle value and the backward angle value while the motors 33 and 34 are operated, the controller 30 stops the operation of the motors 33 and 34.

On the other hand, like (c) of FIG. 7, when the angle value detected from the angle sensor 35 exceeds the backward angle value, the controller 30 may control the motors 33 and 34 so that the cleaner main body 10 moves backward.

When the motors 33 and 34 are operated, the absolute value of the angle value detected from the angle sensor 35 becomes smaller, and thus the cleaner main body 10 is in the state like (a) of FIG. 7.

When the angle value detected from the angle sensor 35 is within the range of the backward angle value and the forward angle value while the motors 33 and 34 are operated, the controller 30 stops the operation of the motors 33 and 34.

That is, according to the present invention, in the process that the cleaner main body 10 moves forward or backward and self-supported by the control of the motors 33 and 34, the distance between the user and the cleaner main body 10 may be maintained within a certain range.

Here, the reference value is not limited but is an angle value and may be set in a form such as 0, 1, 2, (−)1, (−)2.

For example, when the first reference value is 0, the forward angle value for moving the cleaner main body 10 forward is 3, and the backward angle value may be (−)3.

On the other hand, when the second reference value is 1, the forward angle value for moving the cleaner main body 10 forward is 4, and the backward angle value may be (−)2.

Therefore, in the case in which the angle value detected from the angle sensor 35 is 3 while the first reference value is selected, the cleaner main body 10 moves forward, but in the case in which the angle value detected from the angle sensor 35 is 3 while the second reference value is selected, the cleaner main body 10 maintains a suspended state.

Therefore, the forward angle value and the backward angle value are set differently depending on the reference value.

According to the present invention, as the cleaner main body 10 is moved automatically in the cleaning process by the detection of tilt of the cleaner main body 10, the distance between the user and the cleaner main body 10 may be maintained in a certain distance. Therefore, since the user does not need to move the cleaner main body 10 directly, there is an advantage that the cleaning convenience of the user is improved.

Also, since one reference of the plurality of references is determined whenever the cleaning is performed based on the position of the weight center line of the cleaner main body 10, an abnormal motion of the cleaner main body 10 may be prevented.

In the above embodiment, although it is described that the operation of the motors 33 and 34 are controlled based on the angle sensor 35, in contrast, the operation of the motors 33 and 34 may also be controlled by using an acceleration sensor or a gyro sensor. Also in this case, a plurality of reference values about the acceleration sensor or the gyro sensor are stored, and any one of the plurality of reference values may be determined at every cleaning start time.

Even though all the elements of the embodiments are coupled into one or operated in the combined state, the present disclosure is not limited to such an embodiment. That is, all the elements may be selectively combined with each other without departing from the scope of the invention. Furthermore, when it is described that one comprises (or includes or has) some elements, it should be understood that it may comprise (or include or have) only those elements, or it may comprise (or include or have) other elements as well as those elements if there is no specific limitation. Unless otherwise specifically defined herein, all terms comprising technical or scientific terms are to be given meanings understood by those skilled in the art. Like terms defined in dictionaries, generally used terms need to be construed with meanings used in technical contexts and are not construed with ideal or excessively formal meanings unless otherwise clearly defined herein.

Although embodiments have been described with reference to a number of illustrative embodiments thereof, it will be understood by those skilled in the art that various changes in form and details may be made therein without departing from the spirit and scope of the invention as defined by the appended claims. Therefore, the preferred embodiments should be considered in a descriptive sense only and not for purposes of limitation, and also the technical scope of the invention is not limited to the embodiments. Furthermore, the present invention is defined not by the detailed description of the invention but by the appended claims, and all differences within the scope will be construed as being comprised in the present disclosure.

What is claimed is:

1. A vacuum cleaner comprising:

a cleaner main body;

a suction device in communications with the cleaner main body;

a wheel to move the cleaner main body;

a motor to drive the wheel;

a sensor to detect a rotation angle of the cleaner main body;

a memory in which a plurality of reference angles are stored; and a controller which determines one reference angle of the plurality of reference angles and controls the motor depending on a difference between the rotation angle detected by the sensor and the determined reference angle, wherein the controller determines the one of the plurality of reference angles after operating the motor to position the cleaner main body at each of the plurality of reference angles.

2. The vacuum cleaner of claim 1, wherein, when determining the one reference angle of the plurality of reference angles, the controller operates the motor to rotate the main body at each of the reference angles in a second direction which is opposite to a first direction after operating the motor to rotate the main body at the reference angles in the first direction.

3. The vacuum cleaner of claim 2, further comprising a current sensor that detects a current to the motor, wherein, when the motor is operated with respect to each of the plurality of reference angles, a respective current is detected by the current sensor, and the controller determines the one reference angle of the plurality of references angles based on the respective currents, the determined one reference angle having a smallest one of the respective currents detected by the current sensor.

4. The vacuum cleaner of the claim 1, wherein the sensor is one of an angle sensor, an acceleration sensor, or a gyroscopic sensor.

5. The vacuum cleaner of claim 1, wherein the controller determines one reference angles of the plurality of reference angles whenever the vacuum cleaner starts to be operated.

6. The vacuum cleaner of claim 1, wherein, when the difference between the rotational angle detected by the sensor and the determined reference angle is outside a range between a particular forward angle value and a particular backward angle value, the controller controls the motor so that the cleaner main body moves forward or backward based on the difference.

7. The vacuum cleaner of claim 6, wherein one or more of the particular forward angle value or the particular backward angle value is varied depending on the determined reference angle.

8. The vacuum cleaner of claim 6, further comprising an auxiliary wheel provided on the cleaner main body, wherein when the difference between the rotational angle detected by the sensor and the determined reference angle is within the range between the particular forward angle value and the particular backward angle value, the auxiliary wheel is spaced apart from a surface under the cleaner main body and contacting the wheel.

9. A vacuum cleaner comprising:

a cleaner main body;

a suction device in communications with the cleaner main body;

a wheel;

a motor to drive the wheel to move the cleaner main body;

a sensor to detect a movement of a detection target about a rotation center of the wheel; and a controller which determines one reference value of a plurality of reference values, each of the reference values being associated with a respective starting position for the detection target, and controls the motor according to a relative movement of the detection target based on the movement of the detection target detected by the sensor from the starting position associated with determined reference value, wherein the controller determines the one reference value of the plurality of reference values after operating the motor to position the detection target about each of the starting positions associated with the plurality of reference values, and wherein, when the detected value exceeds a forward reference value, the controller controls the motor so that the cleaner main body moves forward, and when the detected value exceeds a backward reference value, the controller controls the motor so that the cleaner main body moves backward.

* * * * *